United States Patent [19]

Leiponen

[11] 4,451,291

[45] May 29, 1984

[54] METHOD AND APPARATUS FOR CONVERTING MATTE, PARTICULARLY HIGH-GRADE MATTE

[75] Inventor: Matti O. Leiponen, Espoo, Finland

[73] Assignee: Outokumpu Oy, Helsinki, Finland

[21] Appl. No.: 445,480

[22] Filed: Nov. 30, 1982

[51] Int. Cl.[3] ..... C22B 15/06

[52] U.S. Cl. ..... 75/73; 75/75; 266/155; 266/157; 422/160; 423/522

[58] Field of Search ..... 266/155, 157; 75/72–75; 423/522; 422/160

[56] References Cited

U.S. PATENT DOCUMENTS

| | | | |
|---|---|---|---|
| 3,497,194 | 2/1970 | Hoff | 75/25 |
| 3,727,587 | 4/1973 | Nebger | 266/157 |
| 4,281,821 | 8/1981 | Kawazoe et al. | 266/144 |

FOREIGN PATENT DOCUMENTS

| | | | |
|---|---|---|---|
| 1053008 | 4/1979 | Canada | 75/75 |

*Primary Examiner*—M. J. Andrews
*Attorney, Agent, or Firm*—John Smith-Hill

[57] ABSTRACT

The invention relates to an apparatus for converting matte in two parallelly connected converters (I, II) with essentially equal blowing rates, corresponding the full capacity of the sulphuric acid plant receiving the process gases. Instead of an arrangement where the following converting periods of the two converters (I, II) are carried out in turns, the converting periods of the converters are now partially overlapping in such a fashion that their blowing periods are staggered, so that blowing is always performed in the first converter while the second converter is being charged or poured. By using this method it is possible to achieve very short waiting periods between the converting periods, additional heating is unnecessary and the pair of converters renders a continuous and even gas flow, which has a higher sulphur dioxide content than normally.

19 Claims, 3 Drawing Figures

METHOD AND APPARATUS FOR CONVERTING MATTE, PARTICULARLY HIGH-GRADE MATTE

The present invention relates to a method for converting matte, particularly high grade matte, in two parallel connected converters having essentially equal blowing rates corresponding the maximum capacity of the sulphuric acid plant receiving the process gases, in which method the converters are being charged between their blowing periods, matte and additives such as fluxes and scrap, and from the converters slag and molten metal are discharged, as well as gases containing sulphur dioxide formed during the blowing, which gases are conducted into a gas processing system, for example through a gas chamber or a waste-heat boiler to a sulphuric acid plant.

The invention also relates to an apparatus for converting matte which contains iron and other impurities, particularly for converting high-grade copper matte into copper, slag and gases containing sulphur dioxide.

In the prior art there is known a method and apparatus for oxidizing high-grade matte received from a flash smelting furnace and containing 60–75% copper, by means of oxygen or oxygen-enriched air, in two parallel connected, tiltable vessels which are operated so that blister copper is poured from the first converter and new matte is charged into the first converter, while the second converter performs the converting, i.e. removing of iron and impurities from the matte during the slag blow and removing of sulphur during the following copper blowing. A good blowing time efficiency has been achieved by using two hot converters instead of only one, because the pouring of the molten metal from, and the charging of new matte into, one converter are carried out during the blowing period of the other converter. By using this arrangement, a blowing time efficiency of roughly 85% has been achieved. Although the converting period itself has been made relatively short by using high-grade copper matte, the waiting period between two successive converting batches is so long in both converters, that oil or other fuel has to be used during the waiting period in order to keep the converter hot. During the converting process itself the reactions between oxygen and the matte are sufficient to maintain the required temperature.

Moreover, by means of this generally known alternating converting arrangement it has not been possible to achieve continuous blowing, because during the skimming of slag and charging of matte, blowing is not carried out in either of the converters.

Thus the alternating converting of matte has not been the best possible method with respect to economical use of energy. Firstly, the converters have to be heated with oil or other fuel during the relatively long waiting periods between the converting batches, which is an expensive alternative compared to heating with oxygen enriched air. The proper use of oxygen creates additional heat which is roughly 50% cheaper owing to the fact that the heat amount escaping from the converter with the nitrogen of the exhaust gases is reduced, as the amount of nitrogen is reduced and the oxygen content increased in the blowing air.

By utilizing the above described, previously known alternating converting arrangement it is also impossible to achieve a continuous and even gas flow. It would be advantageous for a sulphuric acid plant if the gas flow conducted thereinto were continuous and smooth. It would also be advantageous for the gas processing equipment fitted after each converter, as well as for the blowing air equipment, that the gas flow coming out of the converters were continuous and smooth, because a discontinuous and uneven gas flow causes solid substances to gather inside the pipework and the gas processing equipment to cool off. Owing to the fact that the gas processing equipment cools off in between the blowing periods, the production of steam, for example, has remained very small in spite of various closing devices in the ductwork. It has not, however, been possible to achieve a continuous and even gas flow out of the converter, because the blowing has to be interrupted during charging and pouring, and in alternating converting the blowing periods of the two converters must not overlap, because the blowing rate of each converter is dimensioned to the full capacity of the sulphuric acid plant.

Thus the purpose of the present invention is to achieve a method for converting matte, particularly high-grade matte, in two parallel connected converters with essentially equal blowing rates, each dimensioned to the corresponding capacity of the sulphuric acid plant which receives the gases, in which method there is created a continuous and even gas flow and wherein the waiting periods between the blowing periods are so short that no additional fuel is needed. Another purpose of the present invention is to achieve an apparatus for realizing the said method, which apparatus has a considerably simpler and cheaper structure than those of the prior art as regards the blowing air and gas processing equipment.

Particularly the "compact package" formed by the converter vessels and the joint boiler allows for their positioning preferably next to the flash furnace, so that the converter aisle becomes unnecessary.

The present invention is based on the idea that instead of overlapping the converting periods of the two converters as in previously known alternating converting, the blowing periods of the two converters are now overlapped. In the present invention the converting periods of the two converters are thus partially overlapping, and the method of the invention can consequently be called alternating blowing technique, whereas the above described, previously known alternating converting technique is based on the fact that converting is completed in turns in the two converters. In that case in the operation of the converters there are periods during which blowing does not take place in either of the converters, and consequently the gas flow is naturally discontinuous and creates further problems.

In the present invention the converting periods of the two converters are partially overlapping, and therefore the waiting period between the successive converting periods of each converter remains as short as possible, so that the converter in question does not have time to cool off to such extent that additional heating with oil or other fuel should be necessary. Therefore the method of the present invention is very economical as regards the use of energy, and the process gas amounts remain markedly smaller than in the above mentioned, previously known alternating converting arrangement. Thus, by means of the present invention, it is possible to create, in addition to a smooth and continuous gas flow, such gases which have a higher sulphur dioxide content than in the prior art. The processing of such gases in the sulphuric acid plant is much easier and much more economical. Smaller gas amounts also reduce the costs and size of the blowing air and gas processing equipment. In the present invention the gas processing equipment is constructed to be so compact that the gases received from the two converters can be conducted to a joint gas processing apparatus such as a waste-heat boiler. Smaller gas flows also create less splashes, wherefore it is no longer necessary to conduct the gases out of the converter through the uptake, but they can be discharged in a suitable manner to a waste-heat boiler which is fitted between the two converters. The low blowing rate allows more freedom for the equipment design.

By means of the method and apparatus of the present invention it is possible to achieve a 20–25% larger capacity than in an equally-sized apparatus which uses alternating converting technique.

In a preferred embodiment of the invention the operation of the converters is advantageously arranged so that the slag blowing periods of the first converter overlap with the metal blowing periods of the second converter. Here slag blowing means blowing with some fluxing agent present in the operation, in order to eliminate iron and other impurities from the matte, and metal blowing means the following stage or stages, where remaining sulphur is removed from the melt. In between the slag blowing periods, slag is removed from the melt, and more matte and flux are added thereto. In between the metal blowing periods it is possible to add scrap to the melt.

In the method of the present invention the blowing periods are relatively short, preferably about 20–40 minutes long. In slag blowing it is possible, if necessary, to use preheated air, the temperature thereof being roughly 60°–180° C.

The invention is explained below in more detail with reference to the appended drawings, where FIG. 1 is a diagram of the converting process according to the generally known alternating converting technique, with respect to operation time.

Figure 1:
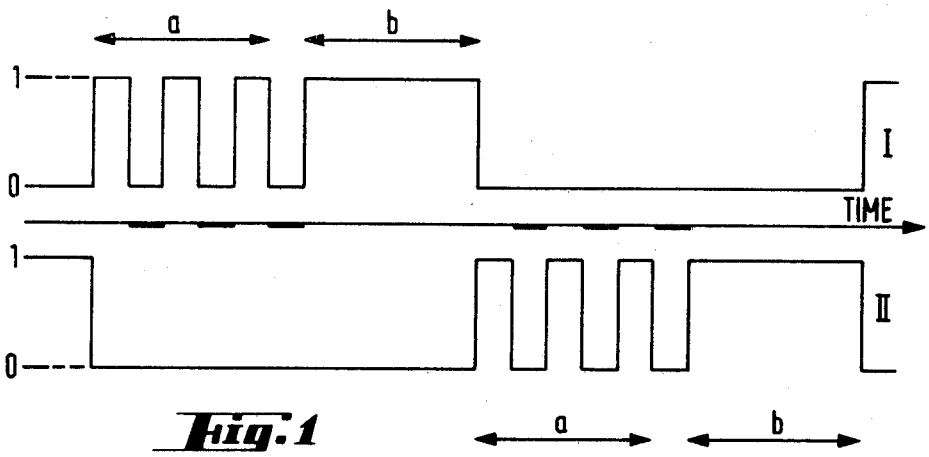
Figure 2:
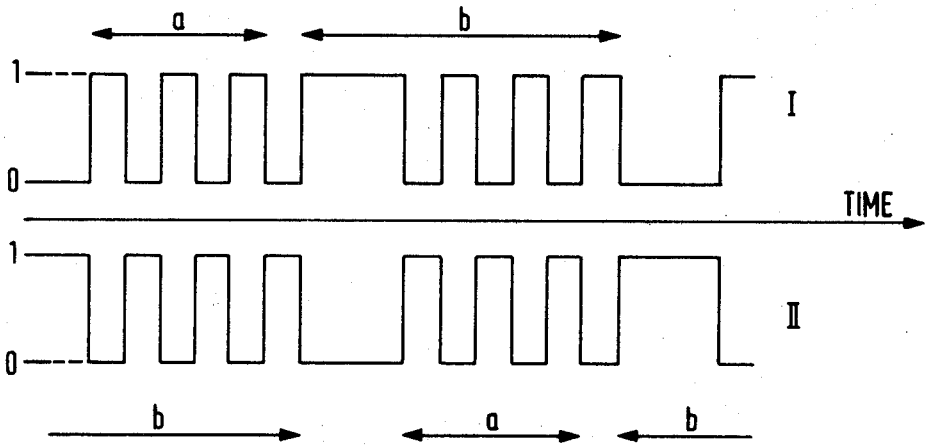
FIG. 2 is a diagram of the converting process according to the alternating blowing technique of the present invention, with respect to operation time.

As is apparent from FIGS. 1–2, each converting period of the two converters I and II is formed of two parts a and b, which are both formed of one or several blowing periods 1 together with the intermediate charging and/or pouring periods 0. Part a generally consists of several slag blowing periods, in between which blowing periods more molten matte and flux such as sand are charged into the converters I and II, and/or slag is skimmed. Part b also comprises one or several blowing periods where the molten matte, cleaned of iron and other impurities, is also cleaned of sulphur by blowing oxygen or oxygen-enriched air into the melt in order to remove the sulphur in the form of gases containing sulphur dioxide. After the slag blowing period a, during the following metal blowing periods b it is possible, in between the blowing periods, to feed into the converters I and II scrap, such as anode scrap, and finally high-grade molten metal is skimmed therefrom.

As is seen in FIG. 1, the successive converting periods a+b of the converters I and II alternate. Now between two successive converting periods a+b of each converter I and II, there remains a waiting period of the same duration as a converting period, during which waiting period the said converter has to be heated with oil or other fuel. In FIG. 1 it can also be seen that between each blowing of the slag blowing period a, there remains a period (the parts of the time axis denoted by a thicker line), when blowing does not take place in either of the converters I or II, which means that the gas flow has completely stopped in both converters.

According to the alternating blowing technique of FIG. 2, only a relatively short waiting period remains between the successive converting periods a+b of each converter I and II, during which waiting period the said converter I or II does not have time to cool off to such extent that additional heating should be necessary. It can also be seen that when the converting periods a+b of the two converter I and II have been matched so that they are partially overlapping according to FIG. 2, dead points are not created but blowing is always carried out in one converter while the other is being charged or tilted. In this fashion it is possible to achieve, in addition to a better time efficiency, smaller, continuous and even gas flows without having to heat the converters with oil or other kind of fuel in between the converting periods.

By utilizing the method and apparatus of the invention, it is possible to achieve a gas flow which is 10–15% more efficient and a capacity which is 20–25% larger than with any previously known alternating converting technique. Owing to smaller gas flows, the whole amount of melt received from the flash smelting furnace can now be treated by using only two converters and one joint waste-heat boiler.

Figure 3:
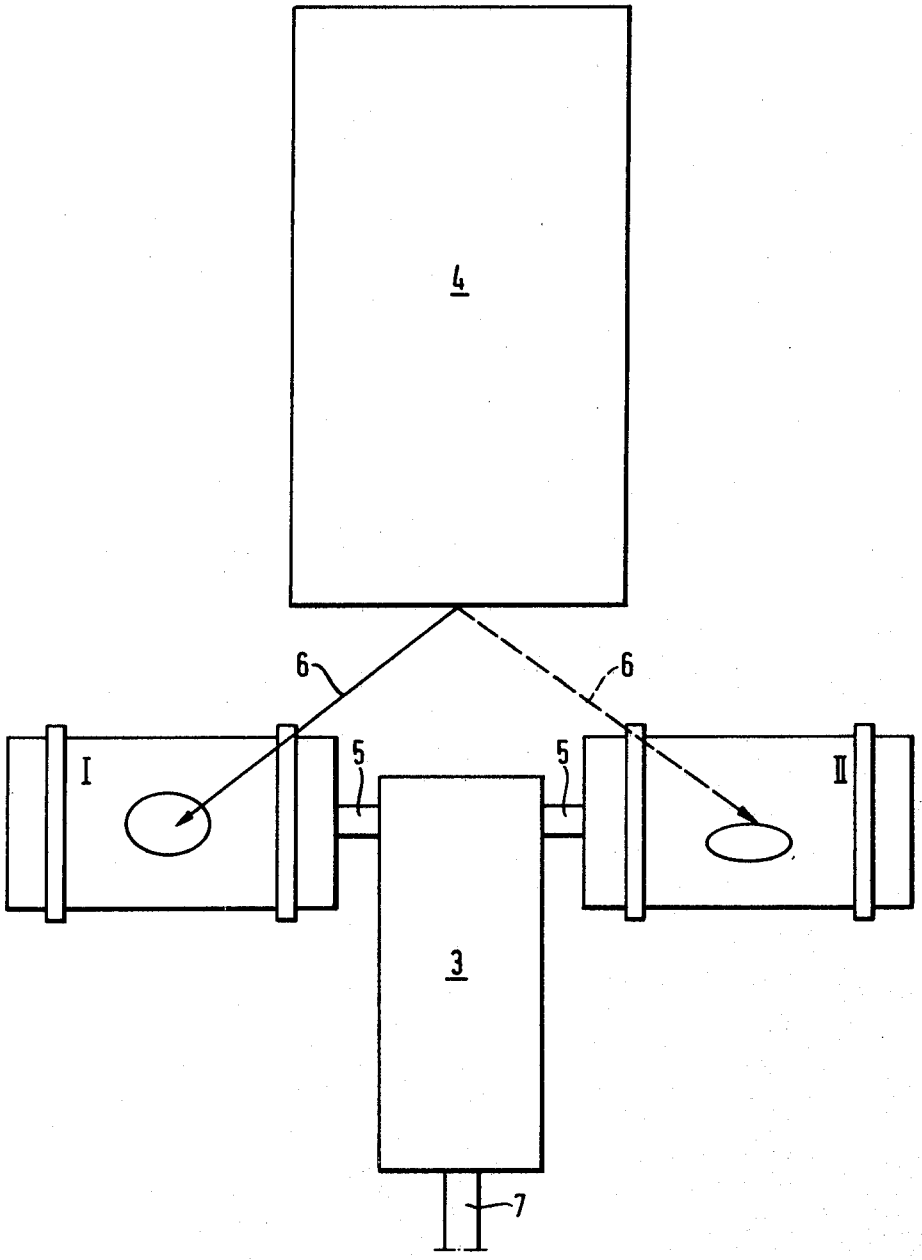
FIG. 3 is a schematic diagram of a preferred embodiment of the present invention seen from the top.

In FIG. 3 the flash smelting furnace is marked with the reference number 4. The outcoming molten flow 6 is divided into two streams, which are conducted to the two converters I and II. Owing to smaller gas amounts, the gas processing channels can also be made much smaller, which allows for the fact that the gas flows received from the two converters I and II can now be conducted to the same gas processing equipment 3, such as a waste-heat boiler or an electro-filter. Owing to smaller gas flows, the amount of splashes is also reduced, and therefore it is possible to conduct the gases through short, easily cleanable pipes 5 from the converters I and II to the equipment 3 located between them, and further to a sulphur processing plant, for example a sulphuric acid plant through pipe 7.

I claim:

1. In combination, an apparatus for converting matte, into metal, slag and gas containing sulphur dioxide, and a gas processing equipment for processing gas containing sulphur dioxide generated during conversion of the matte, said apparatus comprising a pair of essentially equal sized converters disposed in spaced relationship with the gas processing equipment located therebetween, means for feeding oxygen-containing gas to the converters so that such gas can be blown through matte in each converter so as to produce a flow of gas containing sulphur dioxide from the converter, and means connecting the converters in common to the gas processing equipment so that the flows of gas containing sulphur dioxide from the two converters are fed to the gas processing equipment.

2. A combination according to claim 1, wherein the gas processing equipment comprises a waste-heat boiler.

3. A combination according to claim 1, wherein the gas processing equipment comprises an electro-filter.

4. A combination according to claim 1, further comprising a sulphur processing plant connected to the gas processing equipment, said gas processing equipment being operative to pass gas containing sulphur dioxide from the converters to the sulphur processing plant.

5. A combination according to claim 1, further comprising a melting furnace connected in common to the two converters for supplying matte to the two converters.

6. A method of converting matte in at least one pair of converters of substantially equal blowing rates connected in common to a gas receiving equipment, comprising blowing oxygen-containing gas through matte in one converter of the pair, during a plurality of periods in which gas is not blown through matte in the other converter of the pair, which periods are separated by periods in which gas is not blown through matte in said one converter but oxygen-containing gas is blown through matte in said other converter, whereby a substantially continuous flow of gas containing sulphur dioxide is provided to the gas receiving equipment.

7. A method according to claim 6, comprising delivering matte to the two converters from a common smelting furnace.

8. A method according to claim 6, comprising blowing oxygen-containing gas through matte in each converter during a succession of blowing periods of a slag blowing interval, in which flux is present in the converter, removing slag from the converter during the periods between the blowing periods of the slag blowing interval, and blowing oxygen-containing gas through matte in the converter during a succession of blowing periods of a metal blowing interval, the slag blowing interval of said one converter overlapping with the metal blowing interval of the second converter.

9. A method according to claim 8, wherein the periods during which oxygen-containing gas is blown through the matte in each converter are of short duration.

10. A method according to claim 9, wherein said periods are of 20 to 40 minutes duration.

11. A method according to claim 6, wherein the oxygen-containing gas that is blown through the matte in each converter during the blowing periods of the slag blowing interval is preheated air.

12. A method according to claim 11, wherein the temperature of the preheated air is 60 to 180 deg. C.

13. A method according to claim 6, wherein the periods during which oxygen-containing gas is blown through the matte in each converter are of short duration.

14. A method according to claim 13, wherein said periods are of 20 to 40 minutes duration.

15. A method according to claim 8, wherein the oxygen-containing gas that is blown through the matte in each converter during the blowing periods of the slag blowing interval is preheated air.

16. A method according to claim 15, wherein the temperature of the preheated air is 60 to 180 deg. C.

17. A method according to claim 8, wherein the first blowing period of each metal blowing interval of said one converter is longer in duration than the subsequent blowing periods of the metal blowing interval and coincides in time with a waiting period of said other converter, between a metal blowing interval and the next following slag blowing interval.

18. A method according to claim 6, wherein the gas receiving equipment comprises a gas processing equipment and a sulphur processing plant, and the blowing rates of the two converters each correspond to the maximum capacity of the sulphur processing plant.

19. A method according to claim 6, comprising blowing oxygen-containing gas through matte in each converter during a succession of blowing periods of a slag blowing interval, charging the converter with molten matte or flux and removing slag from the converter between the blowing periods of the slag blowing interval, blowing oxygen-containing gas through matte in the converter during a succession of blowing periods of a metal blowing interval, and removing molten metal from the converter following at least one of the blowing periods of the metal blowing interval.

* * * * *